US005727331A

United States Patent [19]

Thaler et al.

[11] Patent Number: 5,727,331

[45] Date of Patent: Mar. 17, 1998

[54] DUAL SWITCH ELECTRIC HAIR DRYER

[75] Inventors: Arnold Thaler, Broward County, Fla.; Tung-hoi Ng, Kowloon, Hong Kong

[73] Assignee: Windmere Corporation, Miami Lakes, Fla.

[21] Appl. No.: 671,375

[22] Filed: Jun. 27, 1996

[51] Int. Cl.[6] ..... A45D 25/00

[52] U.S. Cl. ..... 34/97

[58] Field of Search ..... 34/96, 97; 392/380, 392/383, 384, 385; 219/222, 227; 132/229, 269

[56] References Cited

U.S. PATENT DOCUMENTS

| | | | |
|---|---|---|---|
| 3,261,107 | 7/1966 | Ponczeck et al. . | |
| 3,332,611 | 7/1967 | Bednarski et al. . | |
| 3,518,776 | 7/1970 | Wolff et al. . | |
| 3,885,127 | 5/1975 | Walter et al. . | |
| 3,903,905 | 9/1975 | Tucker . | |
| 3,939,850 | 2/1976 | Wahl . | |
| 4,114,022 | 9/1978 | Braulke, III . | |
| 4,167,660 | 9/1979 | Liedtke . | |
| 4,195,217 | 3/1980 | Moller et al. . | |
| 4,196,343 | 4/1980 | Han | 392/385 |
| 4,198,558 | 4/1980 | Benty . | |
| 4,316,007 | 2/1982 | Carlson . | |
| 4,659,907 | 4/1987 | Andis et al. . | |
| 4,683,369 | 7/1987 | Rieckman et al. | 392/385 |
| 4,904,847 | 2/1990 | Kosaka et al. . | |
| 4,910,385 | 3/1990 | Shye-Long . | |
| 4,977,306 | 12/1990 | Kosaka et al. . | |
| 5,181,328 | 1/1993 | Bouverie . | |
| 5,394,620 | 3/1995 | Chimera . | |

FOREIGN PATENT DOCUMENTS

| | | |
|---|---|---|
| 0 489 382 A2 | 10/1992 | European Pat. Off. . |
| 2 670 093-A1 | 6/1990 | France . |

*Primary Examiner*—Henry Bennett
*Assistant Examiner*—Steve Gravini
*Attorney, Agent, or Firm*—Dickstein Shapiro Morin & Oshinsky LLP

[57] ABSTRACT

A hair dryer including more than one switch to control air flow rate and/or temperature. The switches are located on different portions of the hair dryer, allowing the user to select air flow rate and/or temperature when gripping the dryer in different ways. In one aspect, a switch is mounted like a trigger on a pistol-shaped hair dryer. A collar located entirely around the hair dryer's barrel mechanically links this trigger switch to a lever positioned on the barrel. When the lever on the barrel is squeezed or pulled, the collar rotates around a pivot to activate the trigger. This collar arrangement thus provides a second switch to control the air flow rate and/or temperature of the dryer.

6 Claims, 4 Drawing Sheets

DUAL SWITCH ELECTRIC HAIR DRYER

BACKGROUND

The present invention relates to hair dryers and more particularly to a hair dryer with more than one switch to control the blower and/or heater.

Hair dryers include a blower and heater that direct warm air out of the dryer's barrel. Users desire different air flow rates and temperatures based on personal preference and requirements of hair treatment. Even a single user will require more than one air flow rate and temperature if they are performing hair styling activities.

Hair dryers are often pistol shaped. This allows the user to grip the handle and point the barrel at the hair being dried and aim the warm air from the hair dryer. These hair dryers typically have handle mounted controls so the user can select air flow rates and temperatures while drying their hair. One example of such a hair dryer is U.S. Pat. No. 4,711,988. Sometimes separate switches on the handle control air flow rate and temperature. Other designs use a single switch to control both air flow rate and temperature simultaneously.

Users, however, do not always grip pistol shaped hair dryers by the handle. They sometimes prefer to hold the hair dryer by the barrel. A user may find this a more comfortable or accurate way to aim the dryer. For example, if the user is unable to see the dryer because it is behind their head, or hair is blocking their view, they may be better able to feel where the dryer is pointing when holding the dryer by the barrel. Also, a person drying someone else's hair, such as a hair stylist, may find such a grip more comfortable when used for long periods of time.

A disadvantage of the known hair dryers is that they do not allow users to control air flow rate and temperature when holding the dryer in different positions, such as by either the handle or barrel. This requires that a user switch grips in the middle of drying hair to change the air flow rate or temperature. Alternately, the hand not holding the dryer must be used to change the air flow rate or temperature. This is not practical because the user's other hand is generally performing hair styling activities.

SUMMARY

The present invention alleviates to a great extent these disadvantages by providing a hair dryer including more than one switch to control air flow rate or temperature. Each switch is located on a different portion of the hair dryer, allowing the user to select air flow rate or temperature when gripping the dryer in different ways. This allows an operator to control air flow rate or temperature with the hand holding the dryer without requiring him to hold the dryer in a particular manner.

In one aspect of the present invention, a pistol shaped hair dryer is provided with two switches. The first switch is located at the trigger position and the second switch is mounted on the barrel. Both switches control the air flow rate or temperature of the hair dryer. The barrel mounted switch mechanically activates the trigger switch through a collar arrangement surrounding the barrel.

In another aspect of the present invention, two electrical switches are provided, the first located at the trigger position and the second mounted on the barrel. Both switches independently control the air flow rate or temperature of the hair dryer through associated electrical circuitry.

It is an object of the invention to provide an improved hair dryer.

It is another object of the present invention to provide an improved hair dryer that allows the user to control air flow rate and temperature when gripping the dryer in different ways.

It is another object of the present invention to provide an improved pistol shaped hair dryer that allows the user to control air flow rate and temperature when gripping the dryer's handle or barrel.

It is a further object of the invention to provide a hair dryer with the foregoing advantages which has a mechanical switch that activates an electrical switch, allowing for increased reliability and simple construction.

Other objects and advantages of the present invention will be readily apparent from the following description and drawings which illustrate preferred embodiments of the invention.

DETAILED DESCRIPTION OF PREFERRED EMBODIMENTS

Figure 1:
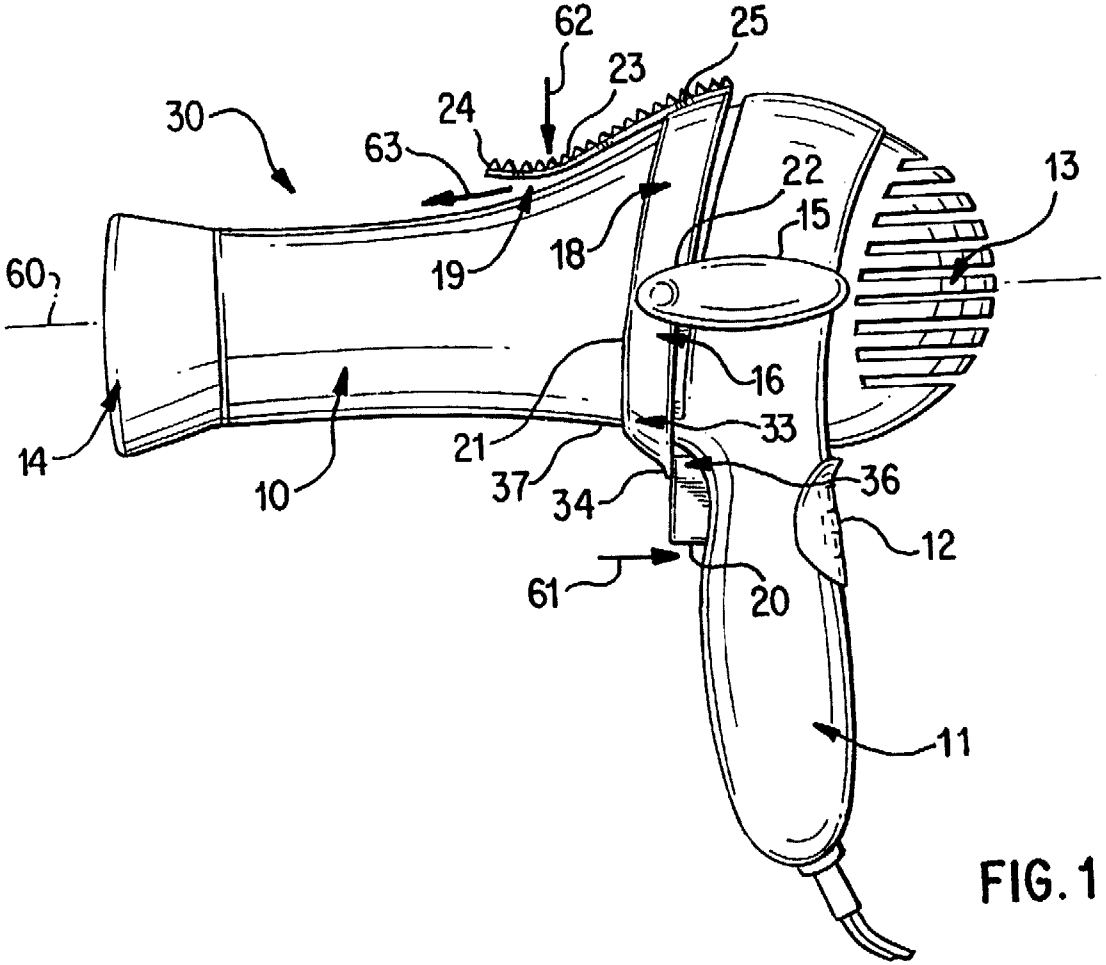
FIG. 1 is a side view of a preferred embodiment of the present invention.

Refer to FIG. 1, which shows a side view of a hair dryer, generally designated by reference numeral 30, according to a preferred embodiment of the present invention. The hair dryer 30 includes a motor driven fan as a blower and an electrical heater (not shown in FIG. 1, but for example as described in U.S. Pat. No. 4,711,988, the disclosure of which is incorporated herein by reference). The hair dryer 30 also includes a barrel 10 connected to a handle 11. A power switch 12 is located on the dryer's handle 11, allowing the dryer 30 to be switched on and off. The power switch 12 is a sliding switch that operates by interrupting or adjusting the electrical resistance in the electrical circuit connected to the blower and the heater. The rear portion of the barrel 10 includes a vent 13 through which air is drawn into the hair dryer 30 by the blower. The barrel 10 also includes a diffuser 14 through which air is blown out of the dryer 30.

A spring biased trigger 20 is located on the handle 11, and is activated when moved in the direction of arrow 61. The trigger 20 controls the air flow rate and/or temperature of the hair dryer 30 through associated electrical circuitry. The trigger 20 might control both the air flow rate and the temperature simultaneously as described in U.S. Pat. No. 4,711,988. When the trigger 20 is released, it returns to the position shown in FIG. 1. The trigger 20 is located so that it can be moved in the direction of arrow 61 with one finger when holding the dryer 30 by the handle 11.

Figure 3:
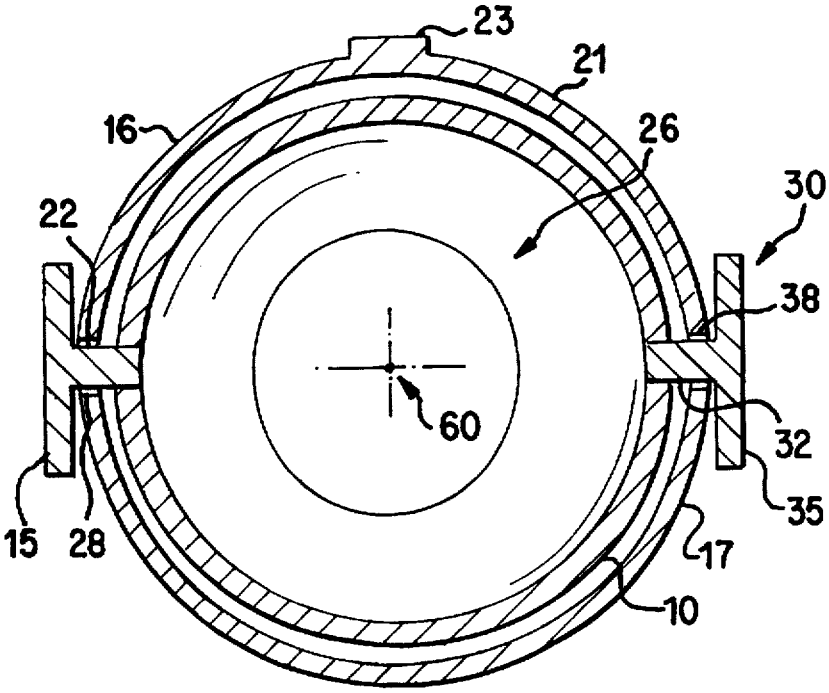
FIG. 3 is a cross sectional view taken along section line III—III of FIG. 2.

The collar 21 is generally ring shaped and positioned completely around the barrel 10. As shown in FIG. 3, there are left and right circular holes 28 and 38 located on the left and right sides 16 and 7 of the collar 21. The left pivot shaft 22 is attached to and extends from the left pivot cover 15. The left pivot shaft 22 passes through the left circular hole 28 and is fused to the hair dryer's barrel 10. Likewise, the right pivot shaft 32 is attached to and extends from the right pivot cover 35, passes through the right circular hole 38 located on the right side 17 of the collar 21, and is fused to the hair dryer's barrel 10. The pivot shafts 22, 32 are shown as being integrally molded with the pivot covers 15, 25, but a two piece construction or other construction can also be used to attach the pieces.

Referring back to FIG. 1, the collar 21, the pivot shafts 22 and 32, and the trigger 20 are configured and positioned so that moving the top of the collar 18 toward the diffuser 14 will rotate the collar 21 about the pivot shafts 22 and 32. The bottom of the collar 21 includes a lip 34 that is positioned proximate to the spring biased trigger 20. Thus, the rotation of collar 21 causes the collar lip 34 to move in the direction of the arrow 61, pushing the trigger 20. The collar lip 34 only extends over a portion of the trigger 20, allowing the exposed portion of the trigger 20 to be activated by a user's finger without moving the collar lip 34. The bottom portion of the barrel 37 engages and prevents the collar 21 from rotating the collar lip 34 away from the trigger 20.

Figure 2:
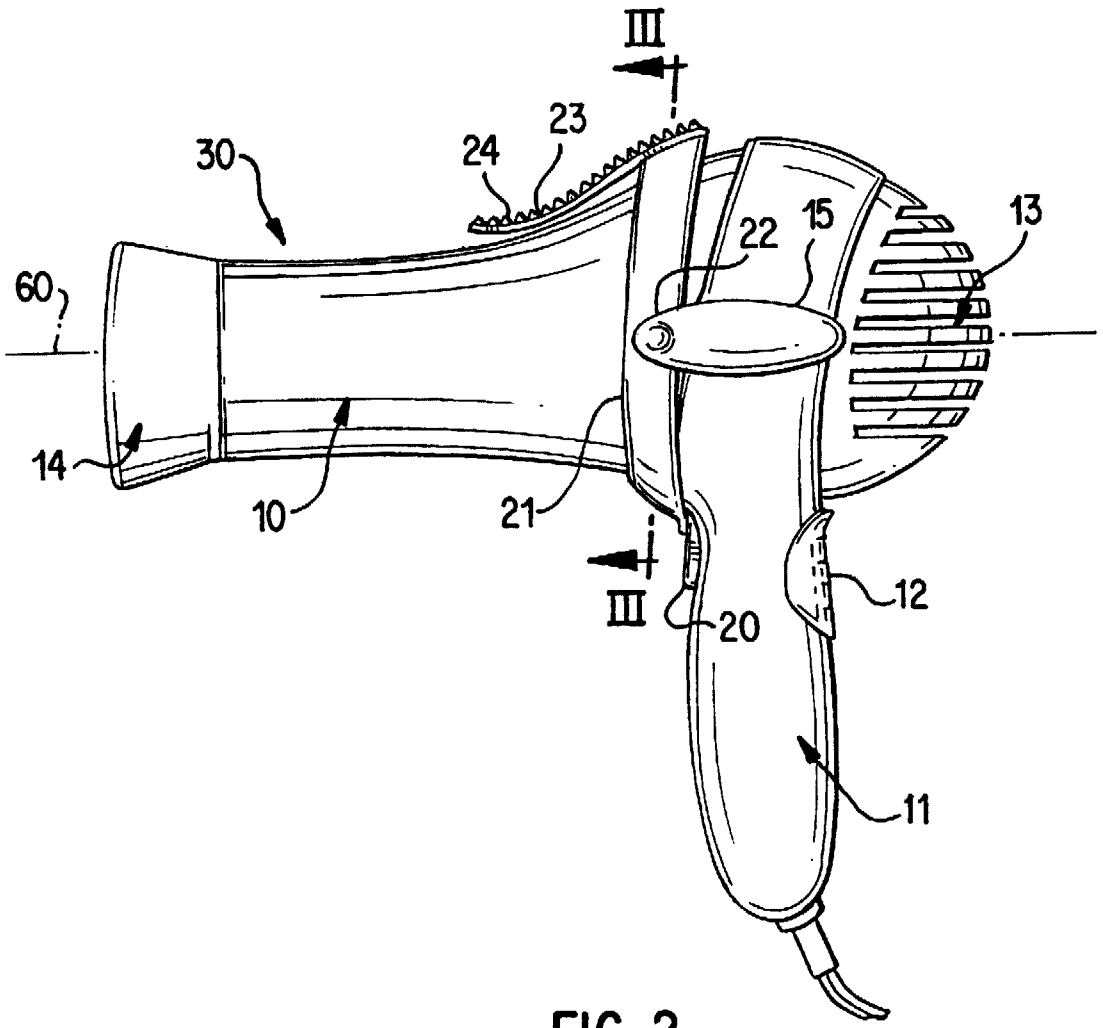
FIG. 2 is a view like FIG. 1 with the trigger activated through movement of the collar arm.

The collar arm 23 includes a collar arm connecting end 25 and a collar arm distal end 24. The collar arm 23 can be made of plastic, metal or alternate material. The collar arm connecting end 25 connects the collar arm 23 to the collar 21. The collar arm 23 generally follows the curve of the barrel 10, and is positioned a distance 19 from the barrel 10. The collar arm 23, the distance 19, the collar 21, the pivot shafts 22 and 32, and the trigger 20 are chosen so that when the collar arm 23 is urged, such as by the user's hand, in either of the directions approximately shown by the arrows 62 or 63, the collar 21 rotates about the pivot shafts 22 and 32. This rotation activates the trigger 20 by moving it in the direction of the arrow 61. FIG. 2 shows the collar 21 in such a position. The trigger 20 is likewise activated when the collar arm 23 is moved in a direction between those shown by the arrows 62 and 63. The trigger 20 is spring biased so that it returns to the position shown in FIG. 1 when not depressed by the collar arm 23.

The collar arm distal end 24 of the collar arm 23 curves slightly away from the barrel 10. This provides a grip for the hand or finger of a user holding the dryer 30 to easily move the collar arm 23 in the direction of the arrows 62 or 63 with a single finger, as discussed with reference to FIG. 4. The collar arm 23 can be textured on the side opposite the barrel 10, making it easier for the user to move the collar arm 23. This allows the collar arm 23 to be the user interface portion of the collar arrangement. Thus, the collar arm 23 becomes a second switch by which the user can control the air flow or temperature of the hair dryer 30.

Refer now to FIG. 3, which shows a cross sectional view of the collar 21 and barrel 10 taken along cross section line III—III of FIG. 2. The inside surface 26 of the barrel 10 is visible in FIG. 3, as is the center axis 60 of the collar 21. The collar arm 23 is attached to and extends from the top of the collar 21. The collar arm 23 is shown as being integrally molded with the collar 21, but riveting or hot stamping can also be used to attach the pieces.

Figure 4:
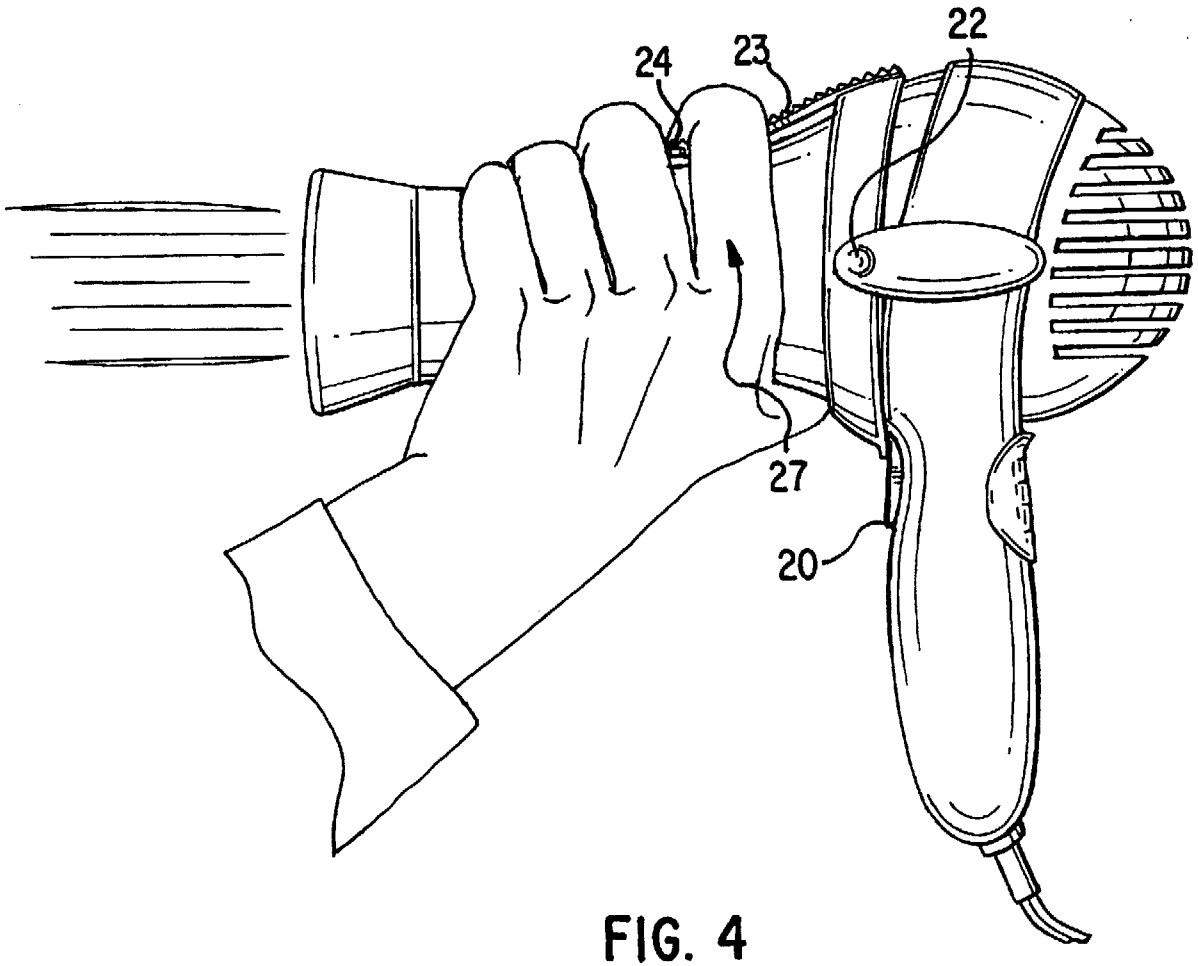
FIG. 4 is a view like FIG. 2 showing the collar arm activated by a user.

Refer now to FIG. 4, which shows how the collar arm 23 could be activated by a user. The user's finger 27 can easily move the collar arm 23, including the collar arm distal end 24, toward the barrel 10 or the diffuser 14. This movement rotates the collar 21 about the pivot shafts 22 to activate the trigger 20.

Figure 5:
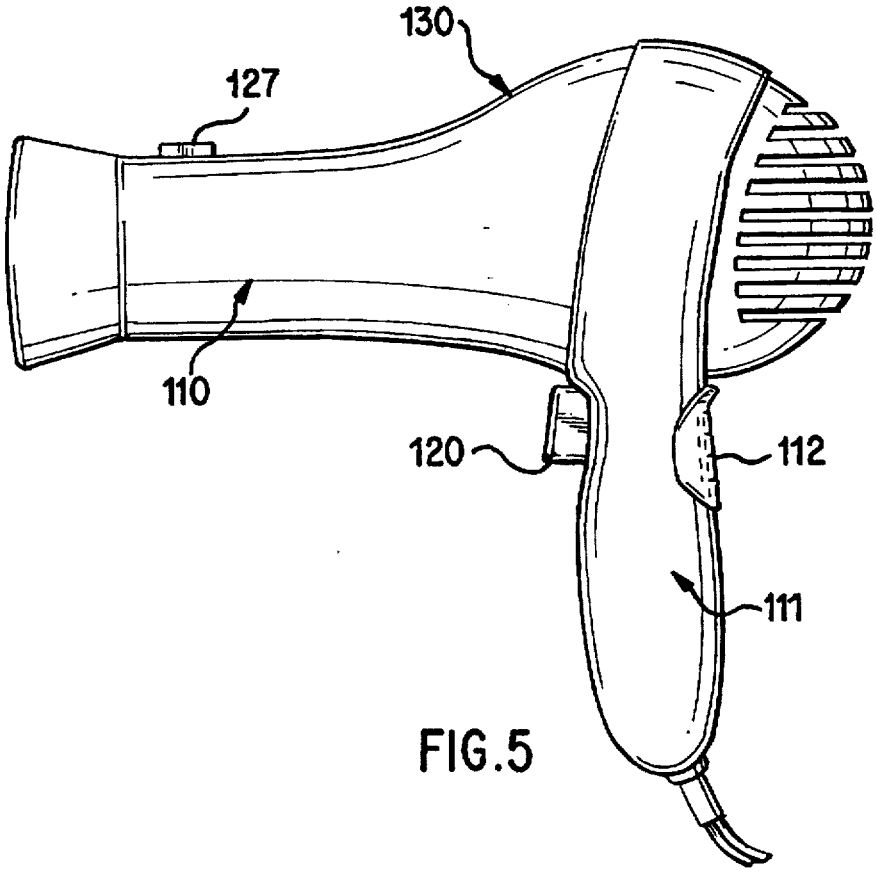
FIG. 5 is a side view of another preferred embodiment of the present invention.

Refer now to FIG. 5, which shows another embodiment of a hair dryer generally designated by reference numeral 130, according to the present invention. In this embodiment, the barrel 110, handle 111, power switch 112 and trigger 120 are similar to the corresponding parts of the hair dryer 30 of FIG. 1. The collar arm and collar arrangement, however, have been replaced with an electrical push button 127 located on the barrel 110. This push button 127 performs the same functions as the trigger 120. That is, both the button 127 and the trigger 120 control the hair dryer's air flow rate and/or temperature through associated electrical circuitry. Thus, the user can hold the dryer by the barrel 110, as shown in FIG. 4, and activate the button 127 with a single finger.

Although preferred embodiments are specifically illustrated and described herein, it will be appreciated that modifications and variations of the present invention are covered by the above teachings and within the purview of the appended claims without departing from the spirit and intended scope of the invention. For example, a hair dryer can be straight through instead of pistol shaped. Such a dryer would not have the handle 11 or a position for the trigger switch 20 shown in FIG. 1. A straight through hair dryer could still, however, have multiple switches allowing the user to control the air flow rate or temperature while holding the dryer in different positions. Similarly, a hair dryer that blows air through a flexible hose could have multiple switches even though there may not be a position for a trigger type switch.

What is claimed as new and desired to be secured by Letters Patent of the United States is:

1. A hair dryer having a blower comprising: a plurality of switches for controlling the blower, wherein each of said plurality of switches is positioned to be accessed by a user and wherein said plurality of switches includes a first switch for controlling at least one function of said blower and includes a second switch for controlling at least one of said at least one function of said blower, said second switch being located on a different portion of the hair dryer from said first switch and wherein the hair dryer has a handle and a barrel and said first switch is located on the handle and said second switch is located on the barrel.

2. A hair dryer comprising:

(a) a blower for generating a current of air through the hair dryer;

(b) a heater for heating said current of air;

(c) a handle for gripping said hair dryer;

(d) a barrel for aiming said current of air;

(e) a trigger located on the barrel end of said handle to control said blower and said heater through associated circuitry;

(f) a collar located entirely around said barrel and touching said trigger;

(g) a pair of pivot shafts attached to opposite sides of said hair dryer and passing through holes located on opposite sides of said collar; and (h) a collar arm attached to the top of said collar such that movement of said collar arm toward or along said barrel causes said collar to rotate about said pivot shafts and activate said trigger.

3. A hair dryer according to claim 2 wherein said collar arm is made of flexible plastic.

4. A hair dryer according to claim 2 wherein said collar arm contains a collar arm end that curves away from said barrel.

5. A hair dryer according to claim 2 wherein said collar arm is textured on the side opposite said barrel allowing the user to more easily move said collar arm.

6. A hair dryer according to claim 2 wherein said collar arm is integrally molded with said collar.

* * * * *